US008939873B2

(12) United States Patent
Smith

(10) Patent No.: US 8,939,873 B2
(45) Date of Patent: Jan. 27, 2015

(54) DISC HOLDER DOCK

(76) Inventor: Tom Smith, Yorba Linda, CA (US)

( * ) Notice: Subject to any disclaimer, the term of this patent is extended or adjusted under 35 U.S.C. 154(b) by 522 days.

(21) Appl. No.: 13/370,559

(22) Filed: Feb. 10, 2012

(65) Prior Publication Data

US 2012/0142504 A1 Jun. 7, 2012

Related U.S. Application Data

(63) Continuation-in-part of application No. 12/839,636, filed on Jul. 20, 2010, now Pat. No. 8,650,976.

(51) Int. Cl.
*A63B 21/22* (2006.01)
*A63B 23/14* (2006.01)

(52) U.S. Cl.
CPC ..... *A63B 21/22* (2013.01); *A63B 2021/222* (2013.01); *A63B 2220/36* (2013.01); *A63B 2220/56* (2013.01)
USPC ..... 482/110; 482/44; 482/45

(58) Field of Classification Search
CPC .... A63B 23/14; A63B 23/16; A63B 21/0608; A63B 21/22
USPC ..... 206/308.1, 315.1; 74/5.1, 5.12, 5.7; 482/44–46, 92, 110, 49, 148
See application file for complete search history.

(56) References Cited

U.S. PATENT DOCUMENTS

| | | | | |
|---|---|---|---|---|
| 1,629,577 | A * | 5/1927 | Klahn | 74/5.7 |
| 6,170,657 | B1 * | 1/2001 | Allsop et al. | 206/308.1 |
| 6,209,720 | B1 * | 4/2001 | Chen | 206/315.1 |
| 7,102,258 | B2 * | 9/2006 | Shen | 310/50 |
| 2007/0266805 | A1 * | 11/2007 | Dworzan | 74/5.7 |
| 2011/0177923 | A1 * | 7/2011 | Smith | 482/110 |

* cited by examiner

*Primary Examiner* — Loan H Thanh
*Assistant Examiner* — Nyca T Nguyen
(74) *Attorney, Agent, or Firm* — Clement Cheng

(57) ABSTRACT

A disc holder dock includes a top cover having an opening for a driving wheel. The top cover has a cradle area for docking a gyroscopic wrist exerciser. The top cover further has a guide vane for directional guiding of the gyroscopic wrist exerciser. The top cover has a top cover sidewall. A middle frame mounted to the top cover. The driving wheel is mounted to the middle frame. The driving wheel is connected to the middle frame by a support. A lower plate is for holding a disc. The lower plate has a lower plate upper side and a lower plate lower side. The lower plate further includes a disk storage area.

9 Claims, 4 Drawing Sheets

DISC HOLDER DOCK

This application is a continuation in part of the parent application to inventor Tom Smith Ser. No. 12/839,636 Gyro Stabilizer having a filing date of Jul. 20, 2010, the disclosure of which is incorporated herein by reference.

FIELD OF THE INVENTION

The present invention is in the field of disc holders.

DISCUSSION OF RELATED ART

A wide variety of different disk holders have provided disc storage for consumers.

SUMMARY OF THE INVENTION

A disc holder dock includes a top cover having an opening for a driving wheel. The top cover has a cradle area for docking a gyroscopic wrist exerciser. The top cover further comprises a guide vane for directional guiding of the gyroscopic wrist exerciser. The top cover has a top cover sidewall. A middle frame mounted to the top cover. The driving wheel is mounted to the middle frame. The driving wheel is connected to the middle frame by a support. A lower plate is for holding a disc. The lower plate has a lower plate upper side and a lower plate lower side. The lower plate further includes a disk storage area.

A pair of latch protrusions formed on a pair of latch arms, wherein the pair of latch protrusions engage with a pair of lower plate latch connection areas on the lower plate. Each of the pair of latch arms is formed between a latch arm first gap and a latch arm second gap. A bottom flange passes around the periphery of the top cover sidewall. An activation button is electrically connected to a motor that is in turn electrically connected to a battery compartment. The motor is mechanically connected to the driving wheel. A battery compartment cover is formed on an underside of the middle frame. A motor support is for supporting the motor.

The driving wheel protrudes through a rotor opening on the top cover and disposed at a bottom of the cradle area so that the cradle area is configured to support a circumferential opening of a gyroscopic wrist exerciser without touching a spinning rotor. A disc retaining means is formed on the disc storage area of the lower plate. The disc retaining means is formed on the lower plate upper side.

The following call out list of elements can be used as a guide for referencing the element call out numbers of the drawings.

20 Lower Plate
21 Release Protrusion
22 Disc Ring Guide
23 Outside Wall Top Edge
24 Outside Wall Inside Surface
25 Lower Plate Outside Edge
26 Outer Wall Flange

27 Lower Plate Bottom Surface
28 Lower Plate Indent
29 Disc Ring Finger
30 Middle Frame
31 Battery Compartment
32 Driving Wheel
33 Motor Support
34 Motor
35 Lower Screw Mounting Post
37 Motor Bracket
38 Middle Frame Ridge
39 Middle Frame Top Surface
40 Top Cover
41 Top Cover Sidewall
42 Latch Arm
43 Activation Button
44 Guide Vane
144 Lower Guide Vane
45 Rotor Opening
46 Cradle
47 Bottom Flange
48 Latch Arm First Gap
49 Latch Arm Second Gap
51 Latch Protrusion
52 Latch Indent
53 Lower Plate Latch Connection
54 Upper Screw Mounting Post
55 Threaded Connection
56 Lower Plate Lower Surface
57 Disk Storage Area
58 Top Cover Rim
88 Lid Cover
188 Speedometer Window
288 Lid Cover Ridge
388 Mass Sensing Switch

DETAILED DESCRIPTION

The present invention is a product package and starting mechanism for a gyroscopic wrist exerciser.

Figure 1:
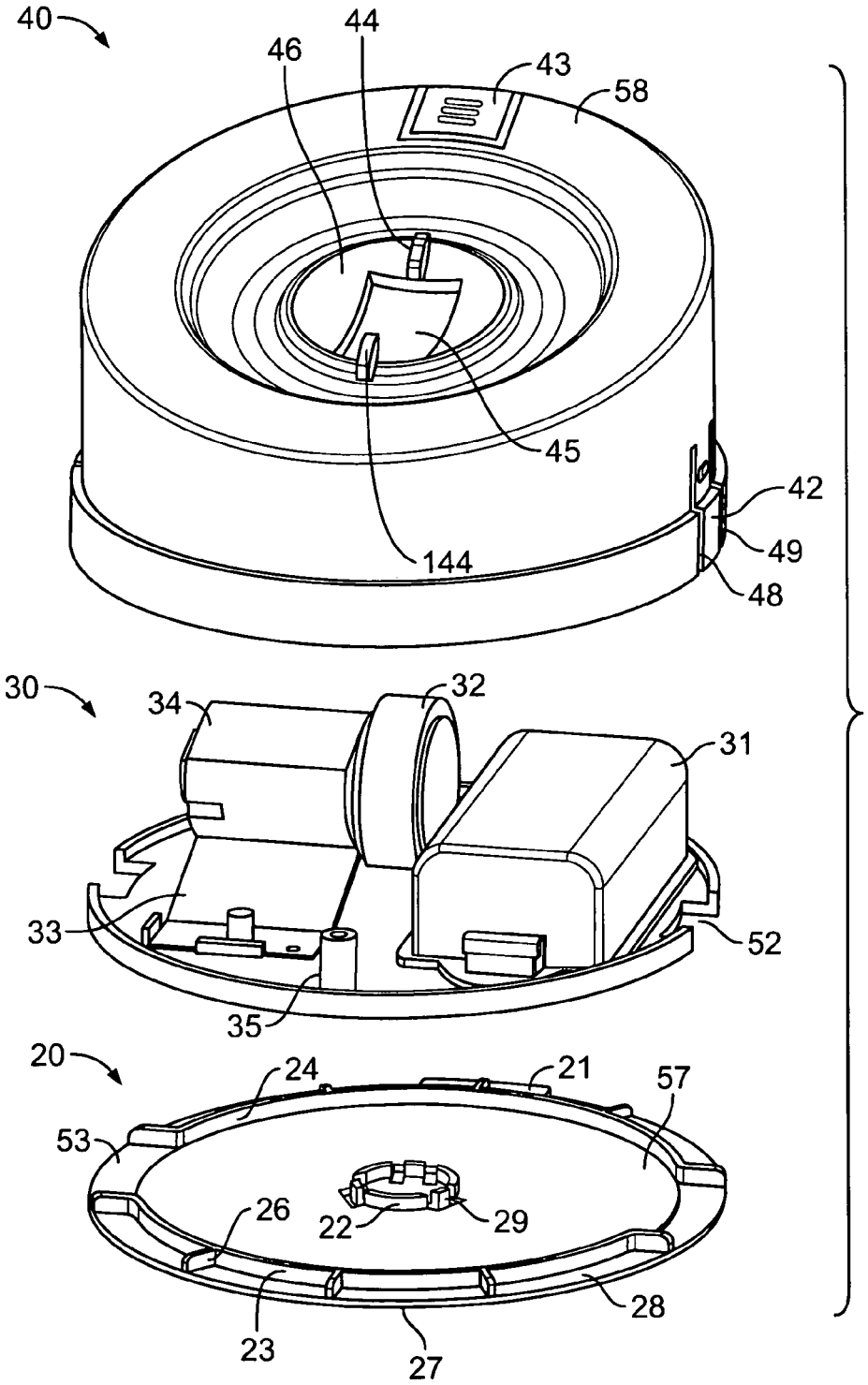
FIG. 1 is a perspective exploded view of the present invention.
Figure 2:
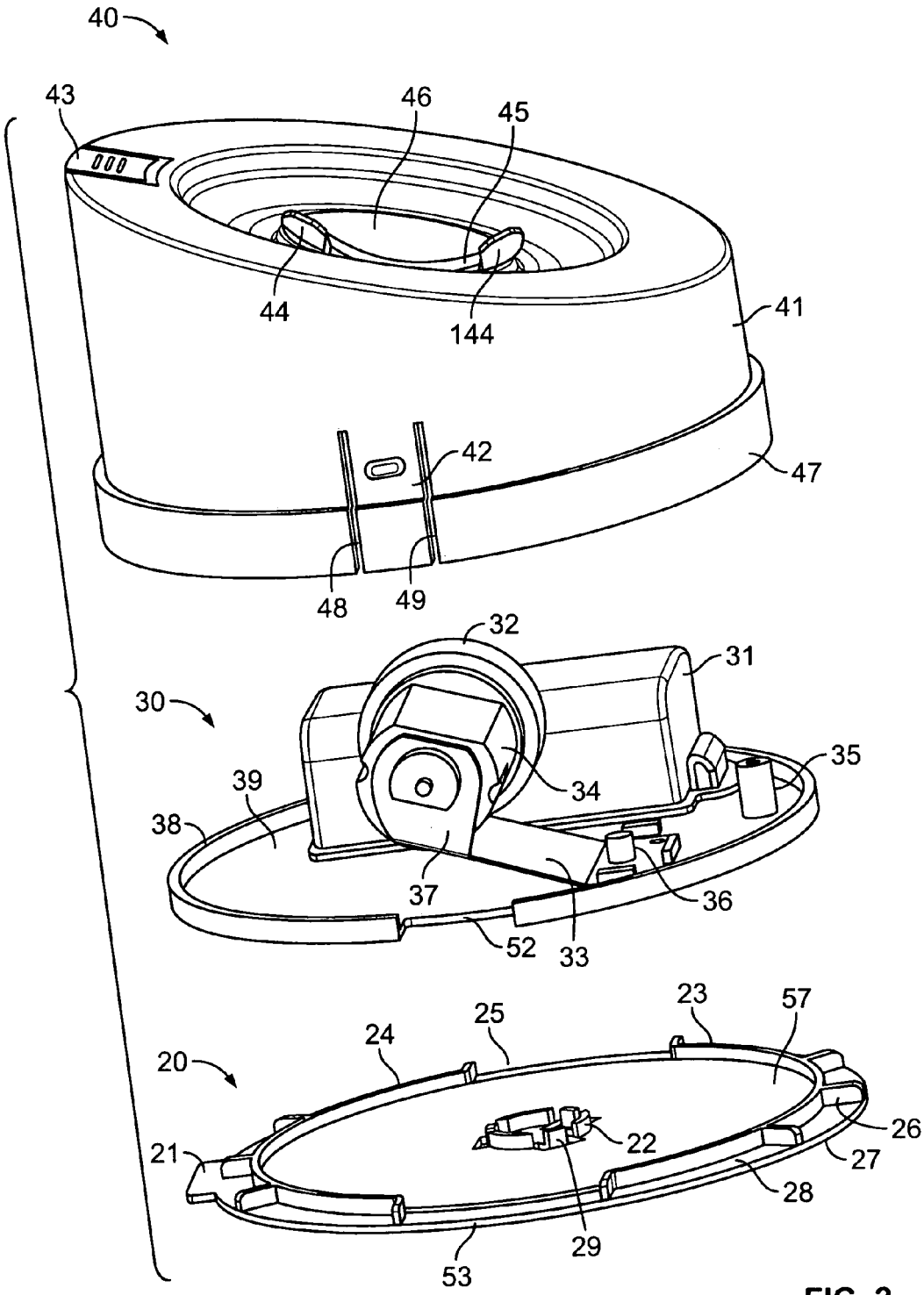
FIG. 2 is a side view of the exploded view of the present invention.
Figure 3:
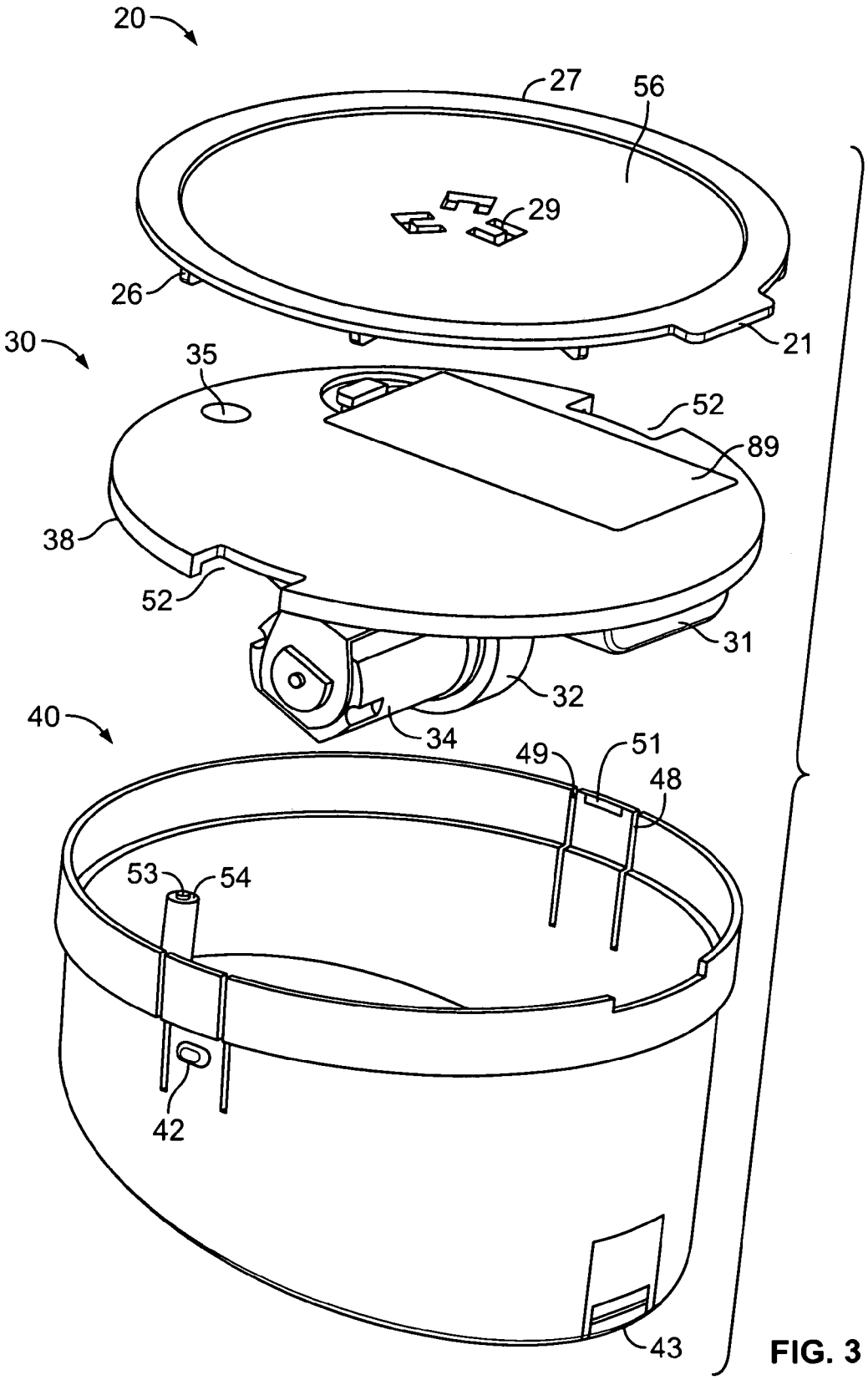
FIG. 3 is a bottom exploded view of the present invention.
Figure 4:
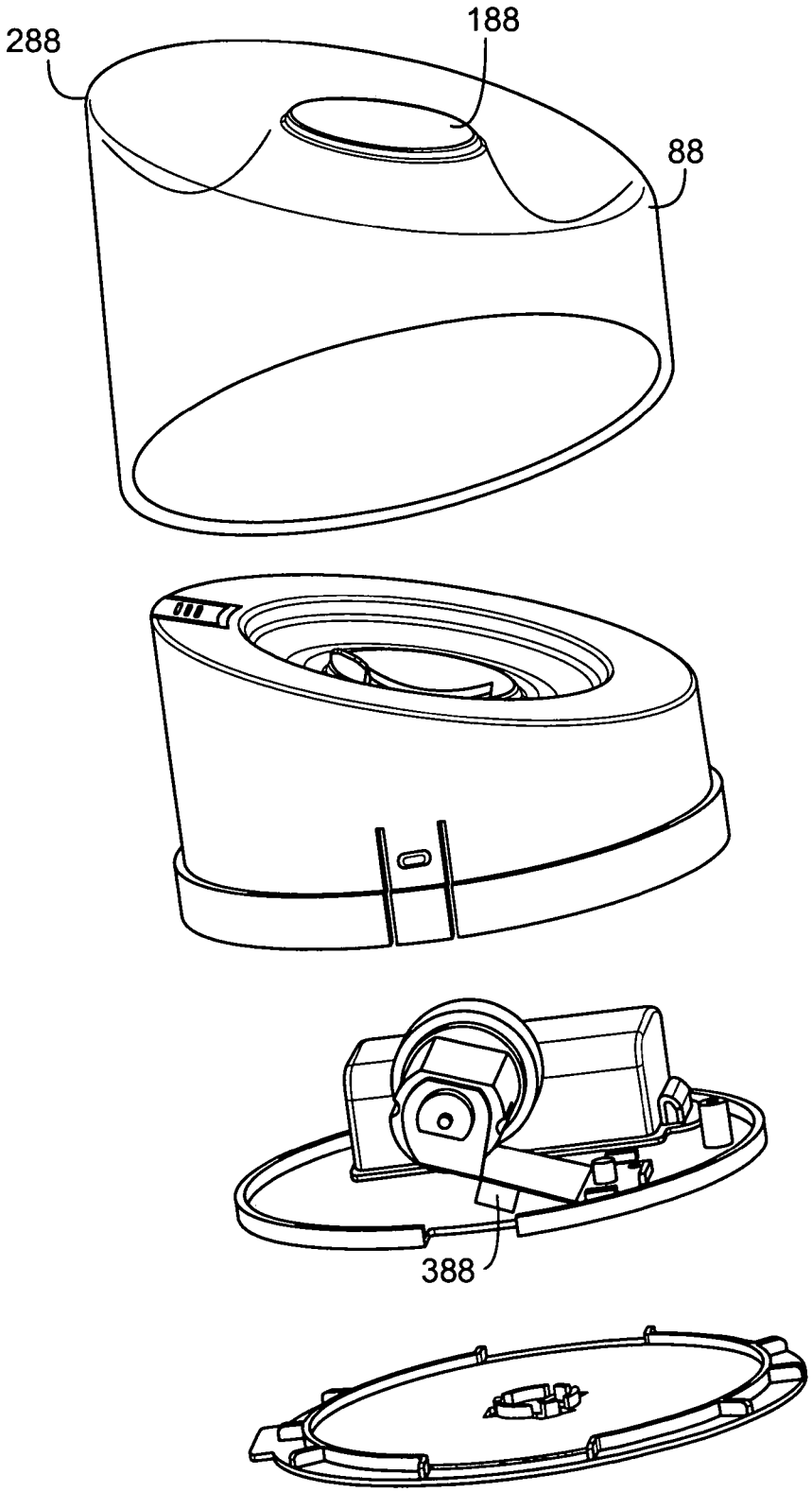
FIG. 4 is an exploded view of the present invention showing the lid cover.

The present invention in FIGS. 1-3 is shown as having three major parts including a lower plate 20 is connected to a middle frame 30 and a top cover 40. The top cover 40 is connected to the middle frame 30 by a threaded connection 55 formed on an upper screw mounting post 54 that connects with a lower screw mounting post 35. The screw mounting posts meet together and a screw is put through from either the bottom side of the top side to connect the posts together. The lower plate 20 connects with the top cover where the latch protrusion 51 meets with a lower plate latch connection area 53. The latch protrusion 51 provides a protrusion to grab onto the edge of the lower plate latch connection area 53. The latch protrusion 51 is mounted to a latch arm 42. The latch arm 42 is formed from a top cover sidewall 41 by forming the top cover sidewall 41 with a latch arm first gap 48 and a latch arm second gap 49. Optionally, finger grip can be disposed on a top portion of the latch arm 42. The latch arm 42 has an area toward the bottom including a bottom flange 47 which passes around the periphery of the top cover sidewall 41 at a base of the top cover 40.

The top cover also has an activation button 43 that is electrically connected to a motor 34 so that it activates a driving wheel 32. The motor is powered by a battery in a battery compartment 31. The battery compartment has a cover 89 on the underside of the middle frame to allow changing of the battery without unscrewing the post-connection between the middle frame and the top cover. The motor is supported on a motor support 33 which can be rigid or flexible or a spring.

The motor 34 can be mounted to a motor bracket 37 which is mounted to the motor support 33. The motor support 33 is mounted to a motor support post 36. The motor support post is integrally formed, bonded or connected to a middle frame top surface 39. The middle frame top surface 39 is bounded by a ridge 38. When the activation button 43 is pressed, the battery in the battery compartment 31 is electrically connected to the motor 34 which then spins the driving wheel 32.

The driving wheel 32 protrudes through a rotor opening 45 on the top cover 40. The rotor opening is preferably rectangular. Above the rotor opening 45 is a guide vane 44. The guide vane 44 provides stability for a groove formed on a rotor of a gyroscopic wrist exerciser. The rotor opening 45 is disposed at a bottom of a cradle 46. The cradle 46 supports a circumferential opening of the gyroscopic wrist exerciser without touching the spinning rotor of the gyroscope.

When a user receives the package with the product, the product will have a gyroscopic wrist exerciser, and the disc holder docking station. The disc has media which may include text, sound or video to instruct a user how to use the device. The user presses on the release protrusion 21 and biases away the latch arm 42 from the lower plate latch connection area 53. Releasing the lower plate 20 which is a lower plate disc holder, the user will see a disk held to the plate. The disc has an opening in the center of the disc. The opening of the disc meets with a disc ring guide 22 whose outer surface is sized to be smaller than the opening in the center of the disc. The disc ring finger 29 is preferably formed as three fingers extending 120° from each other and grasping a portion of the opening in the disc.

An outside wall bounds the outside edge of the disc. The outside wall has an outside wall top edge 23 and an outside wall inside surface 24 which is larger than the disc to allow the disc to fit within the outside wall inside surface. The lower plate outside edge 25 extends beyond the outside wall. The outer wall is supported by a plurality of outer wall flange 26 that can be made perpendicular to the outside wall. The lower plate has a bottom surface 27. The lower plate has a lower plate indent 28 formed between the plurality of outer wall flange 26.

The latch protrusion 51 is formed on the latch and preferably integrally formed with the latch material. The latch protrusion and latch can be made from injection molded plastic. The latch protrusion 51 can be formed as a bayonet style protrusion having a ramp to allow a user to press the disc holder lower plate back onto the bottom of the device after the user has used the disc. A latch indent 52 provide substantial clearance away from the latch protrusion 51 so that the latch protrusion 51 does not catch on the edge of the middle frame 30. The middle frame 30 as a middle frame ridge 38 protruding from a middle frame top surface 39. The lower plate bottom surface 56 can be indented. Therefore, it is preferred that the latch protrusion engage only with the lower plate latch connection 53.

The upper screw mounting post 54 and the threaded connection 55 can be sized so that the upper screw mounting post 54 is higher or lower, or omitted in its entirety if the corresponding lower screw mounting post 35 is correspondingly sized in height. Alternatively, the lower screw mounting post 35 can be higher or lower or omitted depending upon the sizing of the upper screw mounting post 54. The threaded connection 55 can be sized to have a larger or smaller screw.

The disc storage area 57 is bounded by the disc ring guide 22 and disc ring finger 29 on the inside and is bounded by the outside wall inside surface 24 on the outside. Disc retaining means includes a disc ring guide, disc ring finger or outside wall inside surface. The disc ring finger can be mounted to grasp the inside or outside edge of the disc. Sometimes a pair of disc ring fingers can grasp the outside ring area of the disc. It is preferred that the disc ring fingers grasp the inside area of the disc. The disc preferably stores flat abutting the disc storage area 57. The top cover rim 58 provides a flat area that can be an angled flat surface.

Lid cover 88 fits over the top cover. The lid cover can be transparent or translucent. The lid cover can have printed graphic film applied to inside surface of the lid cover. The lid cover can have a slanted top or a flat top. The lid cover can be cylindrical with a flat top edge and a flat bottom edge. The lid cover can be trapezoidal shape from a side view with a slanted top edge and a slanted bottom edge. The lid cover can be trapezoidal with a slanted bottom edge and a flat top. The lid cover 88 retains the gyroscopic wrist exerciser within the cradle.

A speedometer window 188 can be formed on the top of the lid cover 88. The speedometer window 188 allows a user to view a speedometer through the window. The speedometer window 188 can be made to be convex or concave polycarbonate plastic to allow for magnification or artistic distortion of the speedometer read out. The speedometer read out can be located on a speedometer module that is mounted to a gyroscopic wrist exerciser. Optionally, a lid cover ridge 288 can be formed on the top surface of the lid cover 88.

A variety of different modifications can be made to the preferred embodiment, for example placement of the elements in slightly different locations. The guide vane 44 of the cradle 46 can be located on the bottom part of the cradle as a lower guide vane 144. The configuration may have two or one guide vanes and may include a configuration where the top guide vane is omitted and only having the lower guide vane 144.

Therefore, while the presently preferred form of the system has been shown and described, and several modifications thereof discussed, persons skilled in this art will readily appreciate that various additional changes and modifications may be made without departing from the spirit of the invention, as defined and differentiated by the following claims. For example, a mass sensing switch 388 can detect the depression of the driving wheel 32 and the mass sensing switch 388 can then complete the circuit between the battery and motor so as to start the driving wheel. When a user removes the gyroscopic wrist exerciser from the cradle, the mass sensing switch 388 disconnects power to the power wheel 32. The mass sensing switch 388 can be used in conjunction with or independently from the pushbutton starter. The mass sensing switch can be mounted to the motor support, and in that case the activation button would be configured as the mass sensing switch that is depressed by the weight of the gyroscopic wrist exerciser. The activation button can be configured as the mass sensing switch by putting the activation button underneath the pivoting motor support 33 for example.

The invention claimed is:

1. A disc holder dock comprising:

a. a top cover having a rotor opening for a driving wheel, wherein the top cover further includes a cradle area for docking a gyroscopic wrist exerciser, wherein the top cover further comprises a guide vane for directional guiding of the gyroscopic wrist exerciser, wherein the top cover has a top cover sidewall;

b. a middle frame mounted to the top cover, wherein the driving wheel is mounted to the middle frame, wherein the driving wheel is connected to the middle frame by a support;

c. a lower plate for holding a disc, wherein the lower plate has a lower plate upper side and a lower plate lower side, wherein the lower plate further includes a disk storage area; and a battery compartment cover is formed on an underside of the middle frame d. an activation button electrically connected to a motor that is in turn electrically connected to a battery compartment, wherein the motor is mechanically connected to the driving wheel.

2. The disc holder dock of claim 1, further comprising a pair of latch protrusions formed on a pair of latch arms, wherein the pair of latch protrusions engage with a pair of lower plate latch connection areas on the lower plate.

3. The disc holder dock of claim 2, further comprising wherein each of the pair of latch arms is formed between a latch arm first gap and a latch arm second gap.

4. The disc holder dock of claim 1, further comprising a bottom flange which passes around the periphery of the top cover sidewall.

5. The disc holder dock of claim 1, wherein the driving wheel protrudes through said rotor opening on the top cover and disposed at a bottom of the cradle area, wherein the cradle area is configured to support a circumferential opening of a gyroscopic wrist exerciser without touching a spinning rotor of the gyroscopic wrist exerciser.

6. A disc holder dock comprising:

a. a top cover having a rotor opening for a driving wheel, wherein the top cover further includes a cradle area for docking a gyroscopic wrist exerciser, wherein the top cover further comprises a guide vane for directional guiding of the gyroscopic wrist exerciser, wherein the top cover has a top cover sidewall;

b. a middle frame mounted to the top cover, wherein the driving wheel is mounted to the middle frame, wherein the driving wheel is connected to the middle frame by a support;

c. a lower plate for holding a disc, wherein the lower plate has a lower plate upper side and a lower plate lower side, wherein the lower plate further includes a disk storage area; and a battery compartment cover is formed on an underside of the middle frame d. disc retaining means formed on the disc storage area of the lower plate;

e. a pair of latch protrusions formed on a pair of latch arms, wherein the pair of latch protrusions engage with a pair of lower plate latch connection areas on the lower plate; wherein the disc retaining means is formed on the lower plate upper side;

f. an activation button electrically connected to a motor that is in turn electrically connected to a battery compartment, wherein the motor is mechanically connected to the driving wheel.

7. The disc holder dock of claim 6, further comprising wherein each of the pair of latch arms is formed between a latch arm first gap and a latch arm second gap.

8. The disc holder dock of claim 6, further comprising a bottom flange which passes around the periphery of the top cover sidewall.

9. The disc holder dock of claim 6, wherein the driving wheel protrudes through said rotor opening on the top cover and disposed at a bottom of the cradle area, wherein the cradle area is configured to support a circumferential opening of a gyroscopic wrist exerciser without touching a spinning rotor of the gyroscopic wrist exerciser.

* * * * *